US008342150B2

(12) United States Patent
Renner

(10) Patent No.: US 8,342,150 B2
(45) Date of Patent: Jan. 1, 2013

(54) COMPRESSOR CONTROL FOR DETERMINING MAXIMUM PRESSURE, MINIMUM PRESSURE, ENGINE SPEED, AND COMPRESSOR LOADING

(75) Inventor: Ross Renner, Black Creek, WI (US)

(73) Assignee: Illinois Tool Works Inc, Glenview, IL (US)

( * ) Notice: Subject to any disclaimer, the term of this patent is extended or adjusted under 35 U.S.C. 154(b) by 206 days.

(21) Appl. No.: 12/369,569

(22) Filed: Feb. 11, 2009

(65) Prior Publication Data

US 2010/0199950 A1 Aug. 12, 2010

(51) Int. Cl.
*F02D 41/00* (2006.01)
*F04B 49/00* (2006.01)

(52) U.S. Cl. ..... 123/350; 123/352; 123/357; 417/43

(58) Field of Classification Search ..... 123/347, 123/349, 350, 352, 357, 360, 361, 395; 417/43, 417/44.21; 701/110
See application file for complete search history.

(56) References Cited

U.S. PATENT DOCUMENTS 2,629,537 A 2/1953 Graybrook et al.
4,201,517 A * 5/1980 Ferguson ..... 417/12
4,232,997 A * 11/1980 Grimmer et al. ..... 417/4
4,496,286 A 1/1985 Gagnon
4,561,827 A 12/1985 Beaumont
5,186,142 A * 2/1993 Brunelli et al. ..... 123/339.16
5,224,836 A * 7/1993 Gunn et al. ..... 417/14
5,341,644 A * 8/1994 Nelson ..... 60/627
6,394,758 B1 5/2002 Lee et al.
6,534,958 B1 * 3/2003 Graber et al. ..... 322/11
6,547,524 B2 * 4/2003 Kohli et al. ..... 416/97 R
7,105,774 B2 * 9/2006 Bender et al. ..... 219/133
7,275,916 B2 10/2007 Smith et al.
2004/0191073 A1 * 9/2004 Iimura et al. ..... 417/44.2
2008/0122195 A1 5/2008 Beeson et al.
2008/0264919 A1 10/2008 Helf et al.
2008/0264920 A1 * 10/2008 Leisner et al. ..... 219/133
2008/0264921 A1 10/2008 Kropp et al.
2008/0264922 A1 10/2008 Fosbinder

OTHER PUBLICATIONS

U.S. Appl. No. 12/040,328, filed Feb. 29, 2008 by Beeson.
U.S. Appl. No. 12/358,119, filed Jan. 22, 2009 by Peters.
U.S. Appl. No. 12/358,147, filed Jan. 22, 2009 by Peters.
U.S. Appl. No. 12/361,394, filed Jan. 28, 2009 by Peotter.
U.S. Appl. No. 12/367,400, filed Feb. 6, 2009 by Renner.

* cited by examiner

*Primary Examiner* — Willis R Wolfe, Jr.
*Assistant Examiner* — Anthony L Bacon
(74) *Attorney, Agent, or Firm* — Fletcher Yoder P.C.

(57) ABSTRACT

A load control system, in certain aspects, may be configured to decrease the amount of noise pollution of a prime mover (e.g., engine) of a service pack in that it may not require the prime mover to operate at higher discrete operating speeds to deliver small amounts of air from the air compressor. The load control system may also only increase the speed of the prime mover to a minimum discrete speed required, keeping noise at a minimum. The load control system may also maximize fuel efficiency by not operating the prime mover at the highest discrete speed at all times. More specifically, the lower operating speeds may lead to less fuel consumption.

31 Claims, 6 Drawing Sheets

FIG. 3
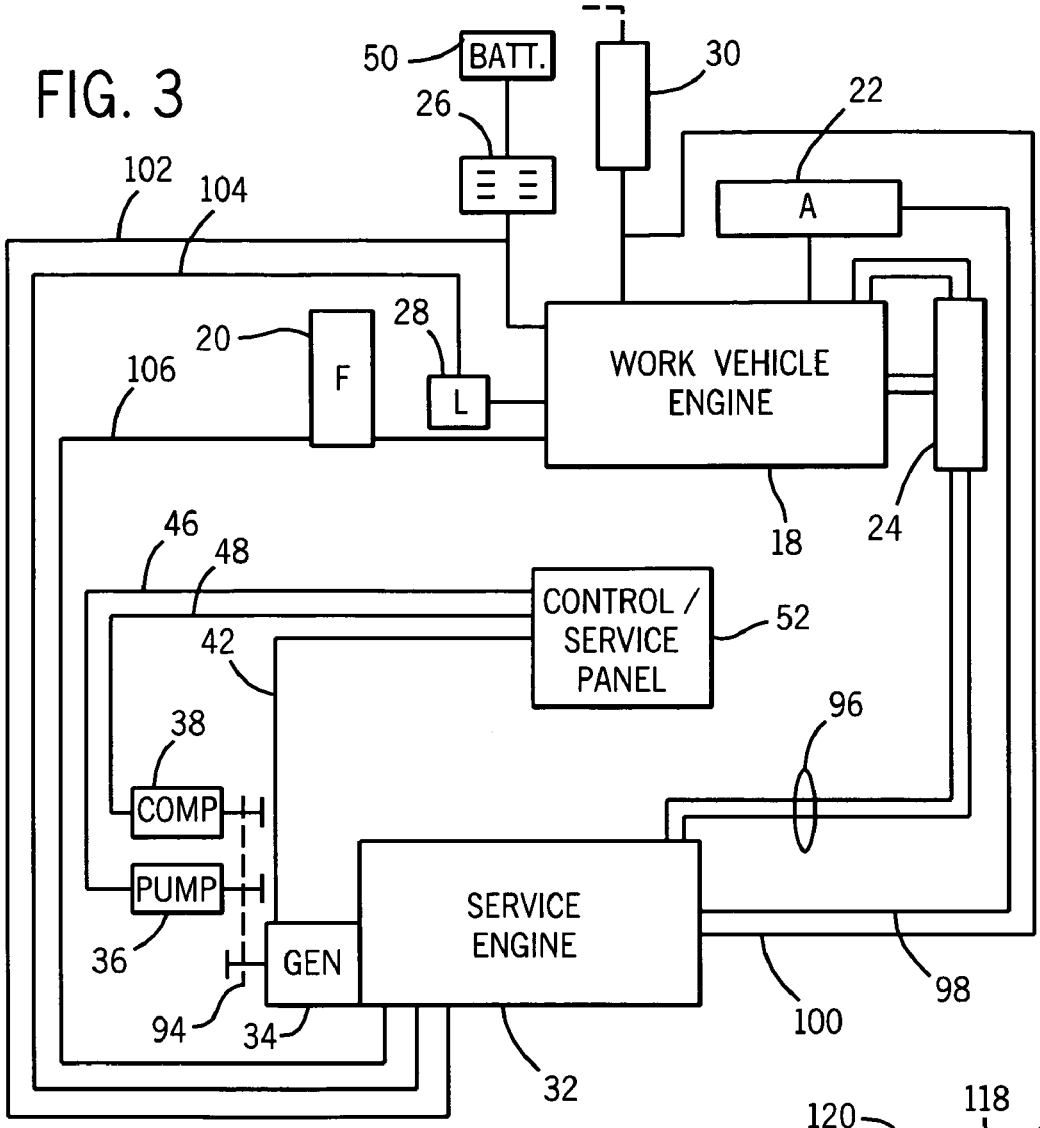
FIG. 4A
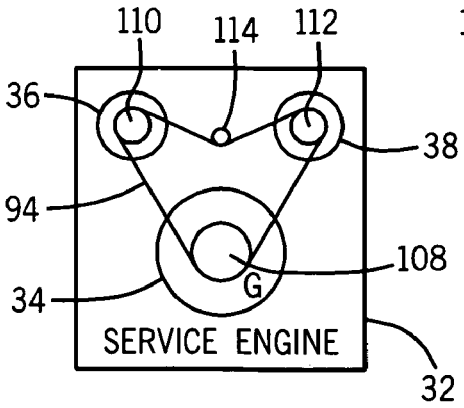
FIG. 4B
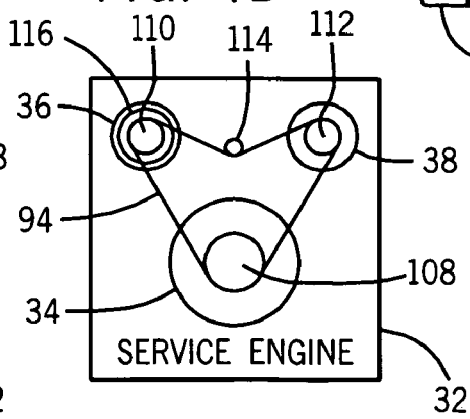
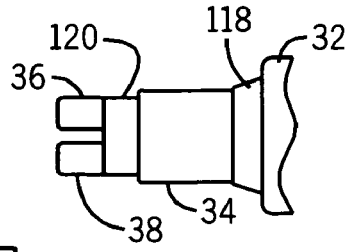
FIG. 4C

COMPRESSOR CONTROL FOR DETERMINING MAXIMUM PRESSURE, MINIMUM PRESSURE, ENGINE SPEED, AND COMPRESSOR LOADING

BACKGROUND

The invention relates generally to a system for controlling the speed of a prime mover (e.g., an engine). More specifically, the invention relates to the control of a prime mover of a work vehicle service pack based on loads of an air compressor of the work vehicle service pack.

The prime mover of the work vehicle service pack generally drives various loads, such as the air compressor, an electrical generator, and a hydraulic pump. These various loads can potentially overload the prime mover, reduce fuel efficiency, increase pollutant emissions, and so forth. In addition, the prime mover may become extremely noisy when driving the loads of the air compressor. More specifically, the prime mover may only operate at a limited number of discrete operating speeds. As such, in order to meet the pneumatic loads, the prime mover may frequently operate at one of the higher discrete operating speeds, increasing the fuel usage of the prime mover.

BRIEF DESCRIPTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

A load control system, in certain aspects, may be configured to decrease the amount of noise pollution of the prime mover (e.g., engine) of a work vehicle service pack. In particular, the load control system may not require the prime mover to operate at higher discrete operating speeds to deliver small amounts of air from the air compressor. The load control system may also only increase the speed of the prime mover to a lower discrete operating speed, keeping noise at a minimum. The load control system may also maximize fuel efficiency by not operating the prime mover at the highest discrete operating speed at all times. More specifically, operating the prime mover at lower operating speeds may lead to less fuel consumption.

DRAWINGS

These and other features, aspects, and advantages of the present invention will become better understood when the following detailed description is read with reference to the accompanying drawings in which like characters represent like parts throughout the drawings, wherein:

FIG. 3 is a diagram of an embodiment of power systems in the work vehicle of FIG. 1, illustrating support systems of the service pack highly integrated with support systems of the work vehicle engine;

FIGS. 4A-4C are diagrams of the service pack with different arrangements of an electrical generator, a hydraulic pump, and an air compressor driven by a service pack engine;

DETAILED DESCRIPTION

Figure 1:
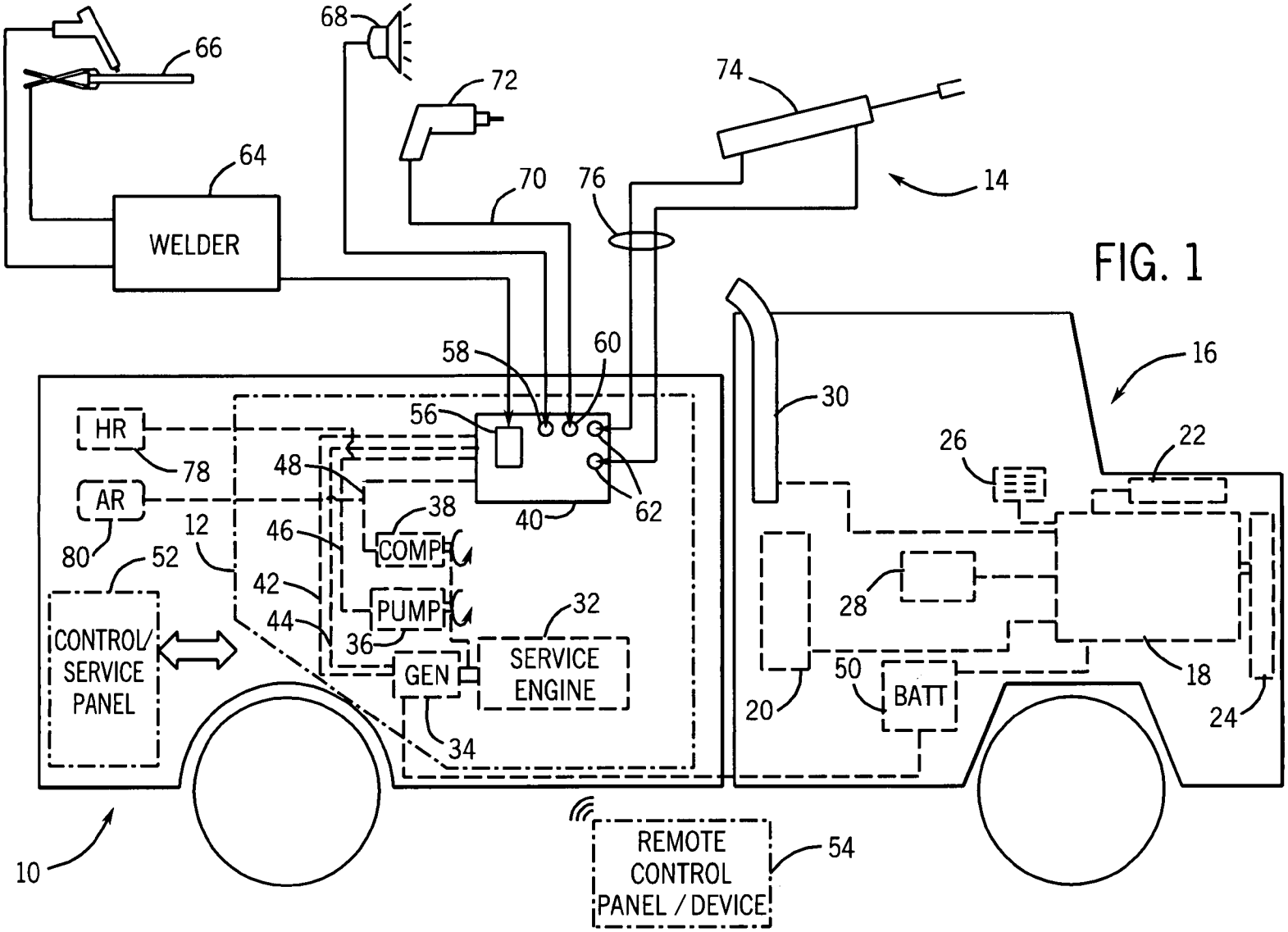
FIG. 1 is a diagram of an embodiment of a work vehicle having a service pack with a load control system.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

In certain embodiments, a load control system may be configured to control an air compressor, which may be a part of a service pack mounted on a work vehicle or other mobile application. The load control system may ensure that the air compressor delivers an adequate amount of air pressure based on a load applied to the air compressor. The load control system may turn the compressor on and off, identify a maximum air pressure that a regulator of the air compressor is set to, and allow for electronically setting a minimum pressure setting that an operator of the air compressor may use. In order to get the maximum amount of air flow from the air compressor, the operating speed of the air compressor may be increased. The load control system may monitor a pressure associated with the air compressor (e.g., the pressure in an air reservoir associated with the air compressor), and may determine whether a load is applied to the air compressor. Based at least in part on this determination, the load control system may decide whether or not to increase the speed of the engine driving the air compressor. The type of load applied to the air compressor may be determined by monitoring the rate of change in tank pressure, the total change from the maximum pressure, whether the pressure has dropped below the minimum pressure setting, and so forth.

At low air compressor loading levels, the load control system may ensure that the engine stays at as low a speed as possible, thereby providing the best fuel economy and lowest noise level. At increased air compressor loading levels, the load control system may increase the engine speed according to the load applied. If the load control system detects that the pressure is falling below the minimum pressure setting, it may increase the engine speed even further. The load control system may, in certain embodiments, have a limited number of discrete operating speeds (e.g., 1800 revolutions per minute (rpm), 2600 rpm, 3200 rpm, and 3600 rpm) but may also operate at a continuously variable speed.

In certain embodiments, the disclosed load control techniques may be used with various service packs to prevent an overload condition of a diesel engine power source that is directly coupled to multiple loads, specifically an air compressor, hydraulic pump, and electrical generators, where the individual and/or combination of these loads have the potential to overload the diesel engine power source. For example, the disclosed embodiments may be used in combination with any and all of the embodiments set forth in U.S. application Ser. No. 11/742,399, filed on Apr. 30, 2007, and entitled "ENGINE-DRIVEN AIR COMPRESSOR/GENERATOR LOAD PRIORITY CONTROL SYSTEM AND METHOD," which is hereby incorporated by reference in its entirety. By further example, the disclosed embodiments may be used in combination with any and all of the embodiments set forth in U.S. application Ser. No. 11/943,564, filed on Nov. 20, 2007, and entitled "AUXILIARY SERVICE PACK FOR A WORK VEHICLE," which is hereby incorporated by reference in its entirety.

FIG. 1 illustrates a work vehicle 10 in accordance with the present invention. The work vehicle 10 is illustrated as a work truck, although any suitable configuration for the work vehicle 10 may be utilized. In the illustrated embodiment, the work vehicle 10 includes a service pack 12 for supplying electrical power, compressed air, and hydraulic power to a range of applications, designated generally by reference numeral 14. The work vehicle 10 has a main vehicle power plant 16 based around a work vehicle engine 18. Although the invention is not limited to any particular configuration or equipment, work vehicle engines of this type will typically be diesel engines, although gasoline engines may be used in some vehicles.

The vehicle power plant 16 may include a number of conventional support systems. For example, the work vehicle engine 18 may consume fuel from a fuel reservoir 20, typically one or more liquid fuel tanks. An air intake or air cleaning system 22 may supply air to the work vehicle engine 18, which may, in certain applications, be turbo-charged or super-charged. A cooling system 24, which may typically include a radiator, a circulation pump, a thermostat-controlled valve, and a fan, may provide for cooling the work vehicle engine 18. An electrical system 26 may include an alternator or generator, along with one or more system batteries, cabling for these systems, cable assemblies routing power to a fuse box or other distribution system, and so forth. A lube oil system 28 may typically be included for many engine types, such as for diesel engines. Such lube oil systems 28 typically draw oil from the diesel engine crankcase and circulate the oil through a filter and cooler, if present, to maintain the oil in good working condition. Finally, the power plant 16 may be served by an exhaust system 30, which may include catalytic converters, mufflers, and associated conduits.

The service pack 12 may include one or more service systems driven by a service engine 32. In a present embodiment, the service pack 12 may provide electrical power, hydraulic power, and compressed air for the various applications 14. In the diagrammatical representation of FIG. 1, for example, the service engine 32 may drive a generator 34, a hydraulic pump 36, and an air compressor 38. The service engine 32 may be of any desired type, such as a diesel engine. However, certain embodiments may use gasoline engines or other types of engines. The generator 34 may be directly driven by the service engine 32, such as by close coupling the generator 34 to the service engine 32, or may be belt-driven or chain-driven. The generator 34 may include three-phase brushless types, capable of producing power for a range of applications. However, other types of generators 34 may be employed, including single-phase generators and generators capable of producing multiple power outputs. The hydraulic pump 36 may be based on any conventional technology, such as piston pumps, gear pumps, vane pumps, and so forth and may be used with or without closed-loop control of pressure and/or flow. The air compressor 38 may also be of any suitable type, such as a rotary screw air compressor. Other suitable air compressors 38 may include reciprocating compressors, typically based upon one or more reciprocating pistons.

The systems of the service pack 12 may include appropriate conduits, wiring, tubing, and so forth for conveying the service generated by these components to an access point 40. Convenient access points 40 may be located around the periphery of the work vehicle 10. In a presently contemplated embodiment, all of the services may be routed to a common access point 40, although multiple access points 40 may certainly be utilized. The diagrammatical representation of FIG. 1 illustrates the generator 34 as being coupled to electrical cabling 42 (for AC power supply) and 44 (for 12-volt DC power supply), whereas the hydraulic pump 36 is coupled to a hydraulic circuit 46, and the air compressor 38 is coupled to an air circuit 48. The wiring and circuitry for all three systems will typically include protective circuits for the electrical power (e.g., fuses, circuit breakers, and so forth) as well as valving for the hydraulic and air service. For the supply of electrical power, certain types of power may be conditioned (e.g., smoothed, filtered, and so forth), and 12-volt power output may be provided by rectification, filtering, and regulating of the AC output. Valving for hydraulic power output may include, by way example, pressure relief valves, check valves, shut-off valves, as well as directional control valving.

In certain embodiments, the generator 34 may be coupled to the work vehicle electrical system 26, and particularly to the work vehicle battery 50. Thus, as described below, not only may the service pack 12 allow for 12-volt loads to be powered without operation of the main work vehicle engine 18, but the work vehicle battery 50 may serve as a shared battery, and may be maintained in a good state of charge by the service pack generator output.

The cabling, circuits, and conduits 42, 44, 46, and 48 may route service for all of these systems directly from connections on the service pack 12. For example, connections may be provided at or near the access point 40 of the service pack 12, such that connections can easily be made without the need to open an enclosure of the access point 40. Moreover, certain control functions may be available from a control and service panel 52. The control and service panel 52 may be located on any surface of the work vehicle 10 or at multiple locations on the work vehicle 10, and may be covered by doors or other protective structures. The control and service panel 52 need not be located at the same location, or even near the locations of the access point 40 to the electrical, hydraulic, and compressed air output points of the service pack 12. For example, the control and service panel 52 may be provided in a rear compartment covered by an access door. The control and service panel 52 may permit, for example, starting and stopping of the service engine 32 by a keyed ignition or starter button. Other controls for the service engine 32 may also be provided on the control and service panel 52. The control and service panel 52 may also provide operator interfaces for monitoring the service engine 32, such as fuel level gages, pressure gages, as well as various lights and indicators for parameters such as pressure, speed, and so forth. The control and service panel 52 may also include a stop, disconnect, or disable switch that allows the operator to prevent starting of the service engine 32, such as during transport.

As also illustrated in FIG. 1, a remote control panel or device 54 may also be provided that may communicate with the control and service panel 52 or directly with the service pack 12 wirelessly. The operator may start and stop the service pack engine 32, and control certain functions of the service pack 12 (e.g., engagement or disengagement of a clutched component, such as the air compressor 38) without directly accessing either the components within the service pack 12 or the control and service panel 52.

As noted above, any desired location may be selected as a convenient access point 40 for one or more of the systems of the service pack 12. In the illustrated embodiment, for example, one or more alternating current electrical outputs, which may take the form of electrical receptacles 56 (for AC power) and 58 (for 12-volt DC power) may be provided. Similarly, one or more pneumatic connections 60, typically in the form of a quick disconnect fitting, may be provided. Similarly, hydraulic power and return connections 62 may be provided, which may also take the form of quick disconnect fittings.

In the embodiment illustrated in FIG. 1, the applications 14 may be coupled to the service pack 12 by interfacing with the outputs provided by the AC electrical receptacle 56. For example, a portable welder 64 may be coupled to the AC electrical receptacle 56, and may provide power suitable for a welding application 66. More specifically, the portable welder 64 may receive power from the electrical output of the generator 34, and may contain circuitry designed to provide for appropriate regulation of the output power provided to cables suitable for the welding application 66. The presently contemplated embodiments include welders, plasma cutters, and so forth, which may operate in accordance with any one of many conventional welding techniques, such as stick welding, tungsten inert gas (TIG) welding, metal inert gas (MIG) welding, and so forth. Although not illustrated in FIG. 1, certain of these welding techniques may call for or conveniently use wire feeders to supply a continuously fed wire electrode, as well as shielding gases and other shielding supplies. Such wire feeders may be coupled to the service pack 12 and be powered by the service pack 12.

Similarly, DC loads may be coupled to the DC receptacle 58. Such loads may include lights 68, or any other loads that would otherwise be powered by operation of the main work vehicle engine 18. The 12-volt DC output of the service pack 12 may also serve to maintain the work vehicle battery charge, and to power any ancillary loads that the operator may need during work (e.g., cab lights, hydraulic system controls, and so forth).

The pneumatic and hydraulic applications may similarly be coupled to the service pack 12 as illustrated in FIG. 1. For example, a hose 70 or other conduit may be routed from the compressed air source at the outlet 60 to a pneumatic load 72, such as an impact wrench. However, many other types of pneumatic loads 72 may be utilized. Similarly, a hydraulic load 74, such as a reciprocating hydraulic cylinder may be coupled to the hydraulic service 62 by means of appropriate hoses or conduits 76. As noted above, certain of these applications, particularly the hydraulic applications, may call for the use of additional valving. Such valving may be incorporated into the work vehicle 10 or may be provided separately either in the application itself or intermediately between the service pack 12 and the hydraulic actuators. It should also be noted that certain of the applications 14 illustrated in FIG. 1 may be incorporated into the work vehicle 10. For example, the work vehicle 10 may be designed to include a man lift, scissor lift, hydraulic tail gate, or any other driven systems which may be coupled to the service pack 12 and driven separately from the main work vehicle engine 18.

The service pack 12 may be physically positioned at any suitable location in the work vehicle 10. For example, the service engine 32 may be mounted on, beneath or beside the vehicle bed or work platform rear of the vehicle cab. In many such work vehicles 10, for example, the work vehicle chassis may provide convenient mechanical support for the service engine 32 and certain of the other components of the service pack 12. For example, steel tubing, rails, or other support structures extending between front and rear axles of the work vehicle 10 may serve as a support for the service engine 32. Depending upon the system components selected and the placement of the service pack 12, reservoirs may also be provided for storing hydraulic fluid and pressurized air, such as hydraulic reservoir 78 and air reservoir 80. However, the hydraulic reservoir 78 may be placed at various locations or even integrated into an enclosure of the service pack 12. Likewise, depending upon the air compressor 38 selected, no air reservoir 80 may be used for compressed air.

The service pack 12 may provide power for on-site applications completely separately from the work vehicle engine 18. That is, the service engine 32 may generally not be powered during transit of the work vehicle 10 from one service location to another, or from a service garage or facility to a service site. Once located at the service site, the work vehicle 10 may be parked at a convenient location, and the main work vehicle engine 18 may be shut down. The service engine 32 may then be powered to provide service from one or more of the service systems described above. In certain embodiments, clutches or other mechanical engagement devices may be provided for engagement and disengagement of one or more of the generator 34, the hydraulic pump 36, and the air compressor 38. Moreover, where stabilization of the work vehicle 10 or any of the systems is beneficial, the work vehicle 10 may include outriggers, stabilizers, and so forth, which may be deployed after parking the work vehicle 10 and prior to operation of the service pack 12.

Figure 2:
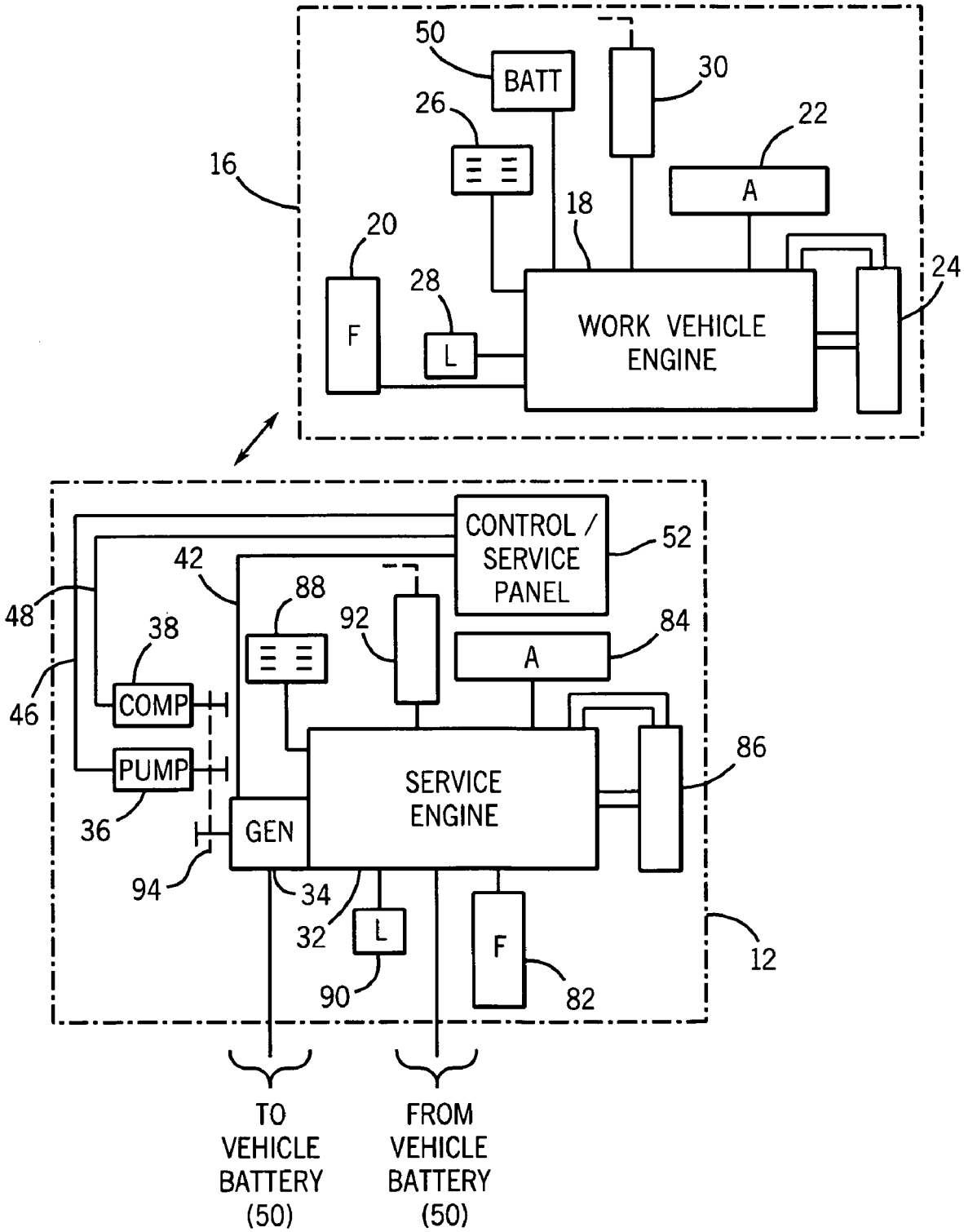
FIG. 2 is a diagram of an embodiment of power systems in the work vehicle of FIG. 1, illustrating support systems of the service pack completely separate and independent from support systems of a work vehicle engine.

Several different scenarios may be implemented for driving the components of the service pack 12, and for integrating or separating the support systems of the service pack 12 from those of the work vehicle power plant 16. One such approach is illustrated in FIG. 2, in which the service pack 12 is entirely independent and operates completely separately from the work vehicle power plant 16. In the embodiment illustrated in FIG. 2, the support systems for the work vehicle power plant 16 are coupled to the work vehicle engine 18 in the manner set forth above. In this embodiment, the service pack 12 may reproduce some or all of these support systems for operation of the service engine 32. For example, these support systems may include a separate fuel reservoir 82, a separate air intake or air cleaning system 84, a separate cooling system 86, a separate electrical protection and distribution system 88, a separate lube oil system 90, and a separate exhaust system 92.

Many or all of these support systems may be provided local to the service engine 32, in other words, at the location where the service engine 32 is supported on the work vehicle 10. On larger work vehicles 10, access to the location of the service engine 32, and the service pack 12 in general, may be facilitated by the relatively elevated clearance of the work vehicle 10 over the ground. Accordingly, components such as the fuel reservoir 82, air intake or air cleaning system 84, cooling system 86, electrical protection and distribution system 88, and so forth, may be conveniently positioned so that these components can be readily serviced. Also, the hydraulic pump 36 and air compressor 38 may be driven by a shaft extending from the generator 34, such as by one or belts or chains 94. As noted above, one or both of these components, or the generator 34 itself, may be provided with a clutch or other mechanical disconnect to allow them to idle while other systems of the service pack 12 are operative.

FIG. 3 represents an alternative configuration in which the service pack 12 support systems are highly integrated with those of the main work vehicle power plant 16. In the illustrated embodiment of FIG. 3, for example, all of the systems described above may be at least partially integrated with those of the work vehicle power plant 16. Thus, coolant lines 96 may be routed to and from the work vehicle cooling system 24 of the work vehicle 10, while an air supply conduit 98 may be routed from the air intake and cleaning system 22 of the work vehicle 10. Similarly, an exhaust conduit 100 may route exhaust from the service engine 32 to the exhaust system 30 of the work vehicle 10. The embodiment of FIG. 3 also illustrates integration of the electrical systems of the work vehicle 10 and the service pack 12, as indicated generally by electrical cabling 102, which may route electrical power to and from the distribution system 26 of the work vehicle 10. The systems may also integrate lube oil functions, such that lubricating oil may be extracted from both crank cases in common, to be cleaned and cooled, as indicated by conduit 104. Finally, a fuel conduit 106 may draw fuel from the main fuel reservoir 20 of the work vehicle 10, or from multiple reservoirs where such multiple reservoirs are present on the work vehicle 10.

In presently contemplated embodiments, integrated systems of particular interest include electrical and fuel systems. For example, while the generator 34 of the service pack 12 may provide 110-volt AC power for certain applications, its ability to provide 12-volt DC output may be particularly attractive to supplement the charge on the work vehicle battery 50, for charging other batteries, and so forth. The provision of both power types, however, makes the system even more versatile, enabling 110-volt AC loads to be powered (e.g., for tools, welders, and so forth) as well as 12-volt DC loads (e.g., external battery chargers, portable or cab-mounted heaters or air conditioners, and so forth).

Integrated solutions between those of FIG. 2 and FIG. 3 may also be utilized. For example, some of the support systems may be separated in the work vehicle 10 both for functional and mechanical reasons. Embodiments of the present invention thus contemplate various solutions between those shown in FIG. 2 and FIG. 3, as well as some degree of elimination of redundancy between these systems. For instance, at least some of the support systems for the main work vehicle engine 18 may be used to support the service pack 12. For example, at least the fuel supply and electrical systems may be at least partially integrated to reduce the redundancy of these systems. The electrical system may thus serve certain support functions when the work vehicle engine 18 is turned off, removing dependency from the electrical system, or charging the vehicle battery 50. Similarly, heating, ventilating, and air conditioning systems may be supported by the service pack engine 32, such as to provide heating of the work vehicle 10 when the main work vehicle engine 18 is turned off. Thus, more or less integration and removal of redundancy may be possible.

The foregoing service pack systems may also be integrated in any suitable manner for driving the service components, particularly the generator 34, hydraulic pump 36, and air compressor 38, and particularly for powering the on-board electrical system. FIGS. 4A-4C illustrate simplified diagrams of certain manners for driving these components from the service engine 32. In the embodiment illustrated in FIG. 4A, the generator 34 may be close-coupled to the output of the engine 32, such as directly to the engine flywheel or to a shaft extending from the engine 32. This coupling may be disposed in a support housing used to support the generator 34 on the engine block or other engine support structures. A sheave 108 may be mounted to an output shaft extending from the generator, and similar sheaves 110 and 112 may be coupled to the hydraulic pump 36 and air compressor 38. One or more belts and/or clutches may be drivingly coupled between these components, and an idler 114 may be provided for maintaining tension on the belt. Such an arrangement is shown in FIG. 4B, in which the hydraulic pump 36 is driven through a clutch 116, such as an electric clutch. Although not shown specifically, any one of the components may be similarly clutched to allow for separate control of the components. Such control may be useful for controlling the power draw on the service engine 32, particularly when no load is drawn from the particular component, and when the component is not needed for support of the main vehicle engine systems (e.g., maintaining a charge on the vehicle batteries).

These components may be supported in any suitable manner, and may typically include some sort of rotating or adjustable mount such that the components may be swung into and out of tight engagement with the belt to maintain the proper torque-carrying tension on the belt and avoid slippage. More than one belt may be provided on appropriate multi-belt sheaves, where the torque required for turning the components is greater than that available from a single belt. Other arrangements, such as chain drives, may also be used. Moreover, as described above, the generator 34 may also be belt or chain driven, or more than one component may be driven directly by the service engine 32, such as in an in-line configuration. In a further alternative arrangement, one or more of the components may be gear driven, with gearing providing any required increase or decrease in rotational speed from the output speed of the service engine 32. An exemplary arrangement of this type is shown diagrammatically in FIG. 4C. In the illustrated arrangement, a support adapter 118 mounts the generator 34 on the service engine 32, and the hydraulic pump 36 and air compressor 38 are driven by a gear reducer 120. In such arrangements, one or more clutches may still be provided upstream or downstream of the gear reducer 120 for selective control of the components.

The particular component or components that are directly and/or indirectly driven by the service engine 32 may be selected based upon the component and engine specifications. For example, it may be desirable to directly drive the hydraulic pump 36, and to drive the generator 34 via a belt or gear arrangement, permitting the service engine 32 to operate at a higher speed (e.g., 3200 rpm) while allowing a reduced speed to drive the generator 34 (e.g., 1800 rpm for near 60 Hz AC output of a 4 pole generator).

Figure 5:
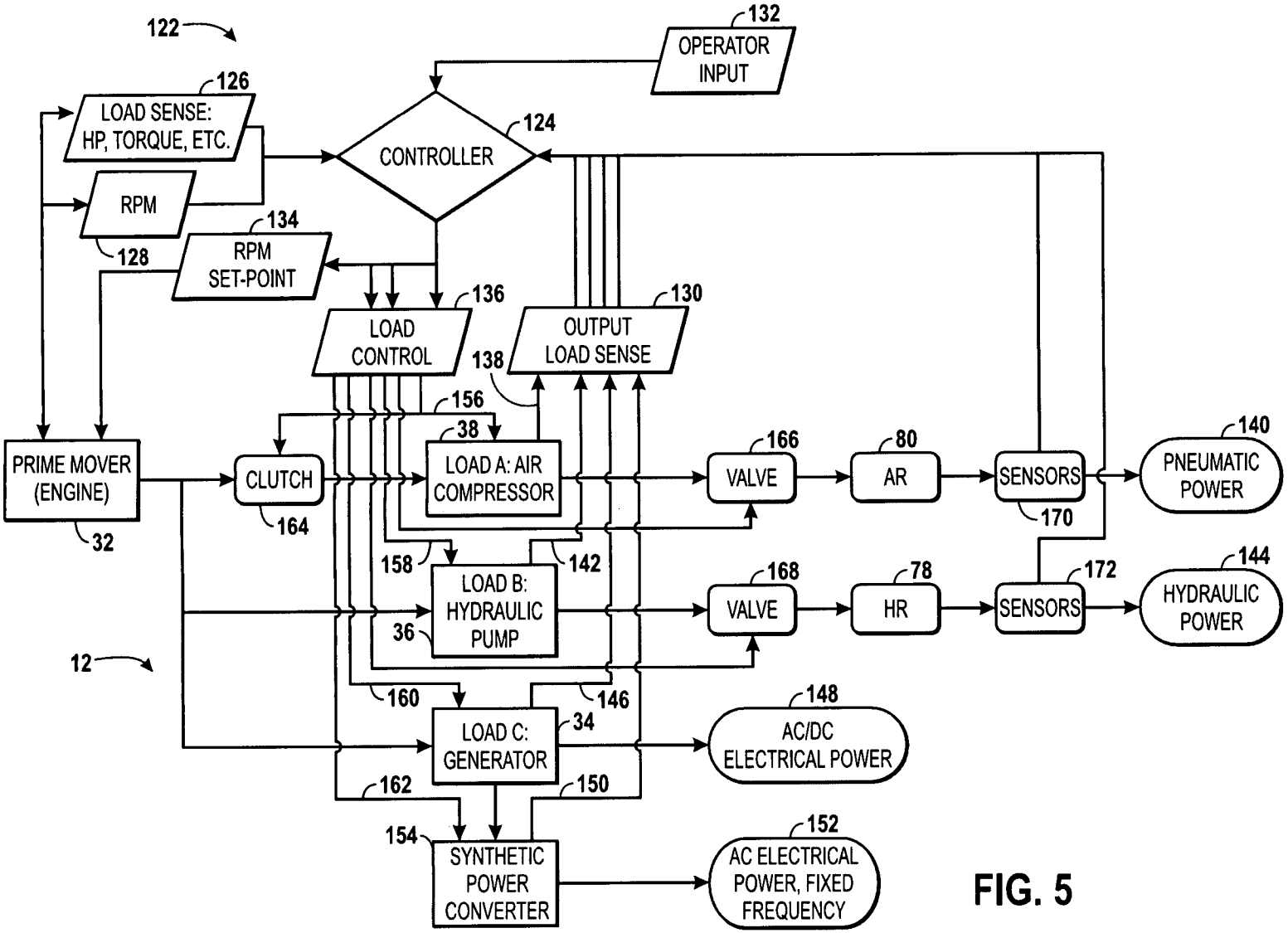
FIG. 5 is a block diagram illustrating an embodiment of the load control system for the service pack of FIGS. 1-4.

FIG. 5 is a block diagram illustrating an embodiment of a load control system 122 for the service pack 12 of FIGS. 1-4. As described in greater detail below, the load control system 122 may be configured to adjust the operating speed of the service engine 32 based at least in part on loads sensed on the air compressor 38. As illustrated, the load control system 122 interfaces with the service engine 32, the air compressor 38 as Load A, the hydraulic pump 36 as Load B, and the generator 34 as Load C. The service engine 32 may be configured to selectively drive one or more of the Loads A, B, and C (e.g., compressor 38, pump 36, and generator 34) based on load sense feedback to a controller 124. In particular, the controller 124 may receive a load sense 126 and/or RPM feedback 128 from the service engine 32. The controller 124 also may receive output load sense 130 from one or more of the Loads A, B, and C (e.g., compressor 38, pump 36, and generator 34). In addition, the controller 124 may receive operator input 132 regarding desired services, priority of the Loads A, B, and C, and so forth. In response to the load sense 126, the RPM feedback 128, and/or the output load sense 130, the controller 124 may provide an RPM set-point 134 to the service engine 32 and/or load control 136 to the various Loads A, B, and C (e.g., compressor 38, pump 36, and generator 34).

In the illustrated embodiment, the controller 124 is configured to manage or control all or part of the major power or load functions of the unit. For example, the controller 124 may utilize the engine load sense 126 signal from the service engine 32 to determine how much additional load can be applied to the engine 32 without overloading the engine 32. For example, the load sense 126 may include a measurement of horsepower, torque, exhaust temperature, throttle/actuator position, or another suitable measurement directly associated with the service engine 32. By further example, the load sense 126 may use throttle/actuator position of a carburetor or fuel injection system as a measurement of fuel quantity being injected into the service engine 32, which in turn provides an indication of load on the service engine 32. Thus, an increase in fuel injection may indicate an increase in load on the service engine 32, whereas a decrease in fuel injection may indicate a decrease in load on the service engine 32. If the load sense 126 indicates or predicts an overload condition on the service engine 32, then the controller 124 can adjust or turn on/off the output to the various Loads A, B, and C (e.g., compressor 38, pump 36, and generator 34) via the load control 136, thereby reducing or preventing the possibility of overloading the service engine 32.

In certain embodiments, the controller 124 utilizes both the engine load sense 126 signal along with the engine RPM feedback 128 signal to accurately determine and manage the load on the service engine 32. The controller 124 can then determine the current load, remaining available load that can be applied to the service engine 32 for a given RPM, and any potential overload condition based on the load sense 126 signal, RPM feedback 128 signal, and RPM set-point 134.

In certain embodiments, the controller 124 may utilize the output load sense 130 signal alone or in combination with the load sense 126 signal and/or RPM feedback 128 signal to accurately determine and manage the load on the service engine 32. For example, the output load sense 130 signal may relate to a pneumatic load 138 associated with pneumatic power 140 generated by the air compressor 38. The pneumatic load 138 may relate to air pressure, air flow rate, or some other suitable load measurement. The output load sense 130 signal may also relate to a hydraulic load 142 associated with hydraulic power 144 generated by the hydraulic pump 36. The hydraulic load 142 may relate to hydraulic pressure, hydraulic flow rate, or some other suitable load measurement. The output load sense 130 signal may also relate to an electrical load 146 associated with AC/DC electrical power 148 generated by the generator 34. Likewise, the output load sense 130 signal may relate to an electrical load 150 associated with AC electrical power (fixed frequency) 152 generated by a synthetic power converter 154 coupled to the generator 34. The electrical loads 146 and 150 may relate to current, voltage, or some other suitable load measurement. Each of these load signals 138, 142, 146, and 150 of the output load sense 130 may be used alone or in combination with the engine load sense 126 and/or RPM feedback 128 to make load adjustments and/or engine adjustments to power match the service engine 32 with the various Loads A, B, and C (e.g., compressor 38, pump 36, and generator 34).

The controller 124 may be configured to generate and transmit load control signals 156, 158, 160, and 162 via the load control 136 to the compressor 38, the hydraulic pump 36, the generator 34, and the synthetic power converter 154 based on load sense 126, the RPM feedback 128, and/or the output load sense 130. For example, the controller 124 may be configured to selectively engage or disengage one or more of the loads (e.g., compressor 38, pump 36, generator 34, and converter 154), individually adjust output levels of the loads, or a combination thereof. For example, the controller 124 may provide load control 136 (via signals 156, 158, 160, and 162) that prioritizes the various loads, and then shuts off and/or reduces output of the less important loads if the service engine 32 cannot meet the demands. For example, the operator input 132 may prioritize the loads as: (1) electrical power 148, (2) pneumatic power 140, (3) electrical power 152, and (4) hydraulic power 144.

However, any other prioritization of the loads may be selected by the user or set as a default for the controller 124. If the controller 124 then receives load sense 126, RPM feedback 128, and output load sense 130 indicative of a possible overload condition on the engine 32, then the controller 124 may provide load control 136 that increases the RPM set-point 134 and/or reduces or shuts off the lowest priority load (e.g., hydraulic power 144). If this is sufficient to prevent an overload condition, then the controller 124 may not make any further changes until the controller 124 identifies another potential overload condition. If this is not sufficient to prevent the overload condition, then the controller 124 may take further measures. For example, the controller 124 may provide load control 136 that further increases the RPM set-point 134 and/or reduces or shuts off the next lowest priority load (e.g., electrical power 152). If this is sufficient to prevent an overload condition, then the controller 124 may not make any further changes until the controller 124 identifies another potential overload condition. However, again, if this is not sufficient to prevent the overload condition, then the controller 124 may take further measures continuing with the next lowest priority loads. In each step, the controller 124 may reduce output and/or disconnect devices coupled to the various loads (e.g., compressor 38, pump 36, generator 34, and converter 154).

Likewise, the controller 124 may provide load control 136 that prioritizes the various loads (e.g., compressor 38, pump 36, generator 34, and converter 154), and then turns on and/or increases power output of the loads in order of priority if the service engine 32 exceeds the demands. In other words, the controller 124 can make adjustments for both overload and underload conditions to better power match the capabilities of the service engine 32 with the loads (e.g., compressor 38, pump 36, generator 34, and converter 154). For example, in the case of an underload condition (e.g., wasted power), the controller 124 may simply reduce the RPM set-point 134 if additional output power is not needed from the compressor 38, pump 36, generator 34, or converter 154. Otherwise, if there is an underload condition and a need for additional output power, then the controller 124 may increase pneumatic power 140, hydraulic power 144, electrical power 148, and/or electrical power 152. Again, the controller 124 may increase power based on the priority of loads (e.g., compressor 38, pump 36, generator 34, and converter 154). Thus, if the highest priority is pneumatic power 140, then the controller 124 may increase pneumatic power 140 prior to increasing hydraulic power 144. However, any suitable priority of loads is within the scope of the disclosed embodiments.

In certain embodiments, the service pack 12 may include a direct coupling, belt and pulley system, gear and chain system, clutch system, or a combination thereof, between the service engine 32 and the Loads A, B, and C (e.g., compressor 38, pump 36, and generator 34). As illustrated, the service engine 32 includes a clutch 164 configured to selectively engage and disengage the air compressor 38. Likewise, a clutch may be used between the service engine 32 and the hydraulic pump 36 and/or the generator 34. The clutch 164 may be used to remove or add a load (e.g., compressor 38) to the service engine 32 based on the load control 136. In some embodiments, the system 122 may include a switch, valve, or other actuator configured to engage and disengage each load, either individually or collectively with the other loads. Indeed, instead of using the clutch 164 to remove or add a load to the service engine 32, in certain embodiments, the clutch 164 may not be used at all. Rather, the service engine 32 may be directly driven and a valve may be turned off and on to activate or deactivate a load (e.g., compressor 38). In any event, the controller 124 can more closely power match the service engine 32 with the various loads (e.g., compressor 38, pump 36, generator 34, and converter 154).

As illustrated, the air reservoir 80 may be associated with a valve 166 for controlling the flow of air from the air compressor 38 to the air reservoir 80. Likewise, the hydraulic reservoir 78 may similarly be associated with a valve 168 for controlling the flow of hydraulic fluid from the hydraulic pump 36 to the hydraulic reservoir 78. In particular, in certain embodiments, the flow of air into the air reservoir 80 may be controlled by selectively engaging or disengaging the clutch 164 while simultaneously disengaging or engaging the valve 166. Further, in other embodiments, the clutch 164 may not be used at all. Rather, in these embodiments, the service engine 32 may be directly driven and the valve 166 alone may be used to control the flow of air into the air reservoir 80. Likewise, the flow of hydraulic fluid into the hydraulic reservoir 78 may be similarly controlled. In addition, the air compressor 38, valve 166, and air reservoir 80 may be associated with sensors 170 for use in the control of the air compressor 38, valve 166, and air reservoir 80. Likewise, the hydraulic pump 36, valve 168, and hydraulic reservoir 78 may be similarly associated with sensors 172 for use in the control of the hydraulic pump 36, valve 168, and hydraulic reservoir 78. More specifically, the sensors 170, 172 may generate signals corresponding to pressure, temperature, flow rate, tank level, vibration, and so forth. These signals may be sent to the controller 124 where they may be utilized for load control 136.

In particular, in the disclosed embodiments, the sensors 170 may enable loads on the air compressor 38 to be sensed. More specifically, in certain embodiments, the sensors 170 may include pressure sensors for sensing changes in pressure within the air reservoir 80. Further, in other embodiments, the sensors 170 may include flow meters for sensing the flow of air to and/or from the air reservoir 80. The control signals relating to the sensed loads on the air compressor 38 may be sent to the controller 124, which may adjust an operating parameter of the service engine 32 based at least in part on the control signals relating to the sensed loads.

Figure 6:
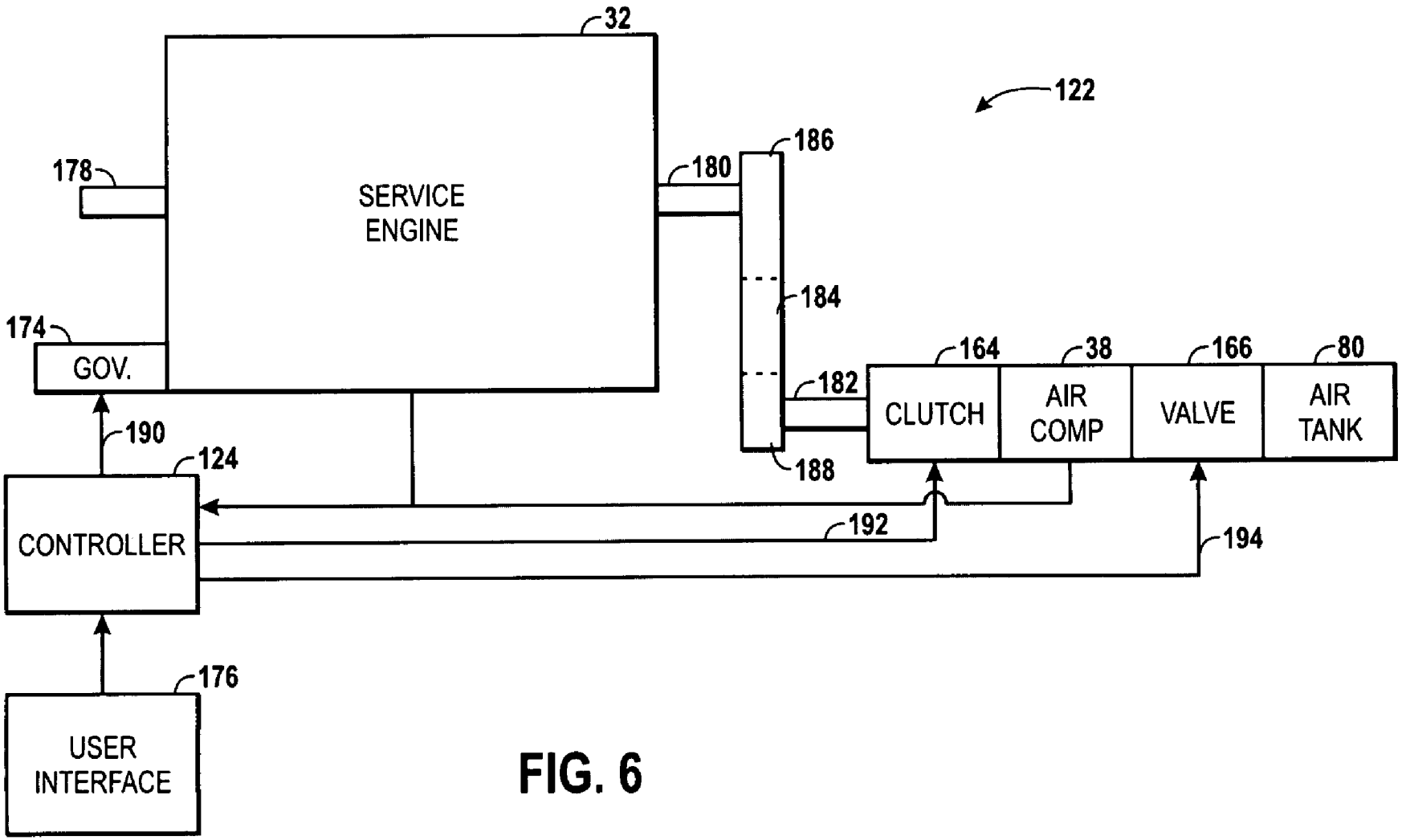
FIG. 6 is another block diagram of an embodiment of the load control system for the service pack, further illustrating how the service engine may be configured to drive the air compressor.

FIG. 6 is another block diagram of an embodiment of the load control system 122 for the service pack 12, further illustrating how the service engine 32 may be configured to drive the air compressor 38. The operating speed of the service engine 32 may be regulated at least in part by the service engine 32, the air compressor 38, and associated equipment. In particular, this section of the load control system 122 may include the service engine 32, the air compressor 38, the air reservoir 80, a governor 174, the clutch 164, the valve 166, the controller 124, and a user interface 176. In this configuration, the speed of the service engine 32 may be regulated at least partially by the governor 174, and the transfer of torque from the service engine 32 to the air compressor 38 may be regulated by the clutch 164. As will be discussed in detail below, the controller 124 may implement a control algorithm to coordinate the operation of the governor 174, the clutch 164, and the valve 166 based on various inputs and parameters, such as pressure drops associated with the air reservoir 80.

The governor 174 may generally be configured to regulate the speed of the service engine 32 based on a desired speed level. In certain embodiments, the service engine 32 may be configured operate at discrete operating speeds (e.g., 1800 rpm, 2600 rpm, 3200 rpm, and 3600 rpm). However, in other embodiments, the service engine 32 may be configured to operate at continuously variable operating speeds. The governor 174 may include an electronic governor configured to control the service engine 32 based on the input control signals and monitored parameters of the service engine 32 and/or the air compressor 38. For example, the governor 174 may receive a speed control signal 190 commanding a given speed and the governor 174 may then generate an output signal to control a throttle of the service engine 32. The output may include an electrical control of the service engine 32 or may include mechanical actuation of the throttle of the service engine 32.

The speed control signal 190 may be generated by the controller 124. In such an embodiment, the speed control signal 190 may be produced based on a control algorithm embedded on memory within the controller 124. For example, the controller 124 may monitor the operating speed and command the governor 174 to increase or decrease the speed of the service engine 32 accordingly. In other embodiments, the governor 174 may include an onboard control loop (such as a proportional-integral-derivative (PID) controller) that regulates the output to the service engine 32. Thus, the governor 174 may independently regulate the service engine 32 to meet the parameters requested by the speed control signal 190 output by the controller 124. In other words, the governor 174 may receive a signal requesting a given speed and implement its own routine to regulate the service engine 32 to the desired speed. The governor 174 may include any mechanism configured to receive the speed control signal 190 and regulate the service engine 32 based on the speed control signal 190.

The governor 174 may be mounted to the service engine 32 in various configurations that enable the governor 174 to regulate the service engine 32. In an embodiment, the governor 174 may be mechanically coupled to the service engine 32. Mechanically coupling the governor 174 to the service engine 32 enables the governor 174 to manipulate components of the service engine 32, including a carburetor throttle shaft, and the like. Mechanically coupling the governor 174 may include providing the service engine 32 with the governor 174 built into the service engine 32, directly attaching the governor 174 to the body of the service engine 32, or providing the governor 174 as a separate component with a linkage to the service engine 32. Other embodiments may include electrically coupling the governor 174 to control circuitry located within the service engine 32.

The clutch 164 is configured to control the transfer of power from the service engine 32 to the air compressor 38. The power transferred may include mechanical power in the form of torque. The service engine 32 may include a drive shaft 178 and a stub shaft 180, which may both be rotated by the service engine 32. For simplicity, the remainder of the discussion refers to the transfer of power via the stub shaft 180, although similar systems may also make use of the drive shaft 178. The stub shaft 180 may be coupled to the compressor drive shaft 182 via a drive belt 184, a pulley 186, and a compressor pulley 188. Accordingly, the power from the service engine 32 may be received by the air compressor 38 as torque. In the illustrated embodiment, the clutch 164 is positioned between the service engine 32 and the air compressor 38 and may be configured to control the transfer of torque between the service engine 32 and the air compressor 38. Configuring the clutch 164 to transfer the torque is generally referred to as engaging the clutch 164. The power required to operate the air compressor 38 may increase the demand for power from the service engine 32. Accordingly, engaging the clutch 164 increases the overall load on the service engine 32, while disengaging the clutch 164 decreases the load of the air compressor 38 on the service engine 32. However, as described above, in certain embodiments, the clutch 164 may not be used at all. Rather, in these embodiments, the service engine 32 may be directly driven and the valve 166 alone may be used to activate or deactivate the air compressor 38.

The clutch 164 may include any device configured to regulate the amount of torque transferred between the service engine 32 and the air compressor 38. For example, an embodiment includes an electric clutch that has two electromagnetic plates complementary to one another. In such an embodiment, the clutch 164 may enable or disable in response to a control signal. For example, if the clutch 164 receives a signal to engage, the electromagnetic plates may be energized to draw the two plates together and create friction. Energizing the plates may include a digital input configured to fully engage or disengage the clutch 164 or an analog input configured to provide proportional friction and, thus proportional transfer of torque. For example, a digital signal may cause the two plates to energize fully and provide full friction. An analog signal may enable the plates to partially energize and, thus, vary the amount of friction generated in the clutch 164. In an embodiment, the clutch control signal 192 configured to operate the clutch 164 may be generated by the controller 124. The clutch 164 may also include any other mechanisms configured to vary the amount of torque transferred between the service engine 32 and the air compressor 38.

The location of the clutch 164 may be varied to accommodate any number of applications. As illustrated in FIG. 6, the clutch 164 is located in-line with the compressor drive shaft 182. Similarly, the clutch 164 may be located in-line with the stub shaft 180 and may be configured to enable or disable the transfer of torque to the pulley 186 and, thus, the torque provided to the air compressor 38. Further, an embodiment may include the clutch 164 built into a pulley. For example, the pulley 186 or the compressor pulley 188 may include a clutch pulley configured to transfer torque via engagement in response to a clutch control signal 192. Further, the load control system 122 may include a belt tensioning mechanism configured to increase or decrease the tension of the drive belt 184 based on the clutch control signal 192. Accordingly, the clutch control signal 192 may be configured to generate a response to tension the drive belt 184 (i.e., enable the clutch).

As described above, the controller 124 is configured to coordinate operation of the load control system 122. More specifically, the controller 124 monitors any number of inputs (e.g., from the service engine 32, the air compressor 38, and so forth), and also outputs various commands to control the operating speed of the service engine 32 via the governor 174 and the power (i.e., torque) transferred to the air compressor 38 via the clutch 164. As illustrated in FIG. 6, the controller 124 is electrically coupled to the governor 174, the clutch 164, and the valve 166. The controller 124 may be configured to transmit various parameters to the governor 174, including the speed control signal 190 indicative of a desired engine operating speed. For example, the speed control signal 190 may include a set level or value representative of the desired engine speed. In response to the speed control signal 190, the governor 174 may regulate the speed of the service engine 32, as described previously.

The controller 124 may also be electrically coupled to the clutch 164 and the valve 166 and may be configured to control engagement of the clutch 164 via the clutch control signal 192 and to control a valve position of the valve 166 via a valve control signal 194. In an embodiment where the clutch 164 is configured to provide a digital clutch control signal 192, the controller 124 may output the clutch control signal 192 above or below a threshold value to enable or disable the clutch 164. For example, based on the determination to engage or disengage the clutch 164, the controller 124 may output a digital high or digital low clutch control signal 192. Similarly, in an embodiment of the clutch 164 that has the ability to incrementally vary the amount of torque transmitted, the controller 124 may output an analog signal proportional to the desired torque transfer. In such a configuration, the clutch control signal 192 may be configured to ramp up transferred torque to reduce the shock to the load control system 122 and the service engine 32 as the air compressor 38 begins to draw power from the load control system 122.

Further, the controller 124 may receive and process various inputs. In an embodiment, inputs to the controller 124 may include any number of engine parameters and system parameters. For example, the controller 124 may receive signals indicative of actual engine speed, a signal relating to engine coolant temperature, engine oil temperature, system temperature, or other parameters related to assessing the performance of the service engine 32. In particular, the controller 124 may receive signals indicative of loads on the air compressor 38 which, in certain embodiments, may be generated by pressure drops within the air reservoir 80. However, in other embodiments, the signals may be indicative of air flow rates, air temperature, load and/or power of the air-driven device, and so forth. As such, the signals may be provided directly from the service engine 32, the governor 174, the clutch 164, the air compressor 38, the valve 166, the air reservoir 80, or any other components of the load control system 122.

The load control system 122 may also incorporate user input via the user interface 176 in communication with the controller 124. In certain embodiments, the user interface may be a part of either the control and service panel 52 or the remote control panel or device 54 of FIG. 1. However, the user interface 176 need not be limited to these two panel components. In an embodiment, the user interface 176 may include a switch or a plurality of switches configured to turn the air compressor 38 off and on. For example, the user interface 176 may include a mechanical or digital switch that the user turns on to start the air compressor 38. Further, the user interface 176 may also include any number of inputs to increase the flexibility of the system. For example, the user interface 176 may enable an operator to enter parameters relevant to a control algorithm implemented by the controller 124.

Figure 7:
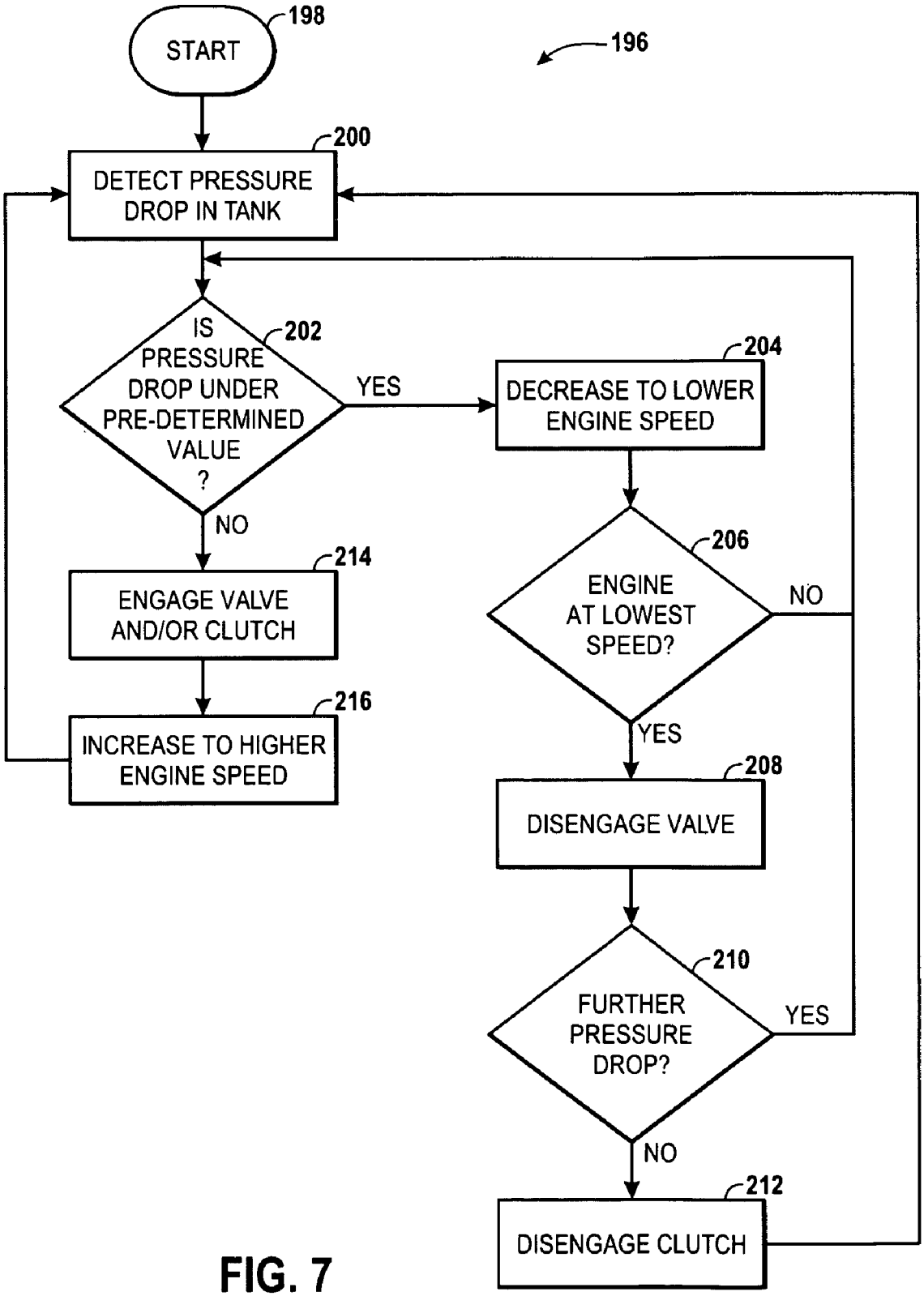
FIG. 7 is a flowchart illustrating an exemplary method for controlling the operating speed of the service engine based on sensed loads on the air compressor.

FIG. 7 is a flowchart illustrating an exemplary method 196 for controlling the operating speed of the service engine 32 based on sensed loads on the air compressor 38. The method may begin at block 198, which may include an operator turning on power to the service engine 32. For example, the operator may flip a switch, such as on the user interface 176 of FIG. 6, to start the service engine 32. In one embodiment, the clutch 164 may be disengaged at startup to ensure that the service engine 32 is started without the additional loading of the air compressor 38. For instance, the controller 124 may maintain the clutch 164 in a disabled state until the controller 124 determines that the service engine 32 is properly configured to support the startup load of the air compressor 38. Embodiments may also include starting the service engine 32 with the clutch 164 in the same state that it was in when the service engine 32 was previously shut down.

Once the air compressor 38 is turned on, the controller 124 may monitor the pressure in the air reservoir 80. This may be done using a micro-processor with an analog-to-digital (ADC) converter coupled to a pressure sensor. As the pressure in the air reservoir 80 increases, the controller 124 may determine a pressure rating set point associated with the air compressor 38. More specifically, the controller 124 may determine the maximum pressure and corresponding ADC value. Conversely, the minimum pressure setting is the pressure at which the operator wants the pressure to stay at or above. This may be set remotely by using the user interface 176. Once the pressure in the air reservoir 80 has stabilized at the maximum pressure setting, the controller 124 may use this maximum pressure setting, along with any change in pressure, to determine loads on the air compressor 38 as well as appropriate responses.

A rate of change in air pressure in the air reservoir 80 may, in certain embodiments, be found by sampling the air pressure at a suitable time increment (e.g., every one second). This value may then be subtracted from the previous sample to find the change. Eventually, a pressure drop will be detected, as illustrated in block 200. If, while at the maximum pressure setting, the change in pressure is less than a pre-determined amount (e.g., less than 0.1%), then the controller 124 may gradually allow the service engine 32 to return to its lowest operating speed. For instance, for illustration purposes, it may be assumed that the service engine 32 has four discrete operating speeds, e.g., 1800 rpm, 2600 rpm, 3200 rpm, and 3600 rpm. Therefore, if the change in pressure is less than the pre-determined amount, the speed of the service engine 32 may gradually be decreased to 1800 rpm. For example, if the original speed of the service engine 32 was 3600 rpm, the controller 124 would step down to 3200 rpm, then 2600 rpm, and finally 1800 rpm. This stepping down of operating speeds may, in certain embodiments, be completed within a few seconds.

For instance, at block 202, the controller 124 may determine whether the change in pressure is below the pre-determined value. If the pressure drop is under the pre-determined value, the method 196 may continue to block 204, where the operating speed of the service engine 32 is decreased. Once the operating speed of the service engine 32 has been decreased, the method 196 may continue to block 206, where it is determined whether the service engine 32 is currently at its lowest operating speed (e.g., 1800 rpm). If the service engine 32 is not currently at its lowest operating speed, the method 196 may continue back to block 202, where the controller 124 may again determine whether the change in pressure is below the pre-determined value.

If, at block 206, it is determined that the service engine 32 is at its lowest operating speed, the method 196 may continue to block 208, where the controller 124 may cause the valve 166 to be disengaged (e.g., closed). The disengagement of the valve 166 may cause the air compressor 38 to cease pushing air into the air reservoir 80 and, therefore, may lower the amount of horsepower (hp) needed from the service engine 32. In certain embodiments, air from the air compressor 38 may also be vented to the atmosphere while sealing off the air reservoir 80. After the valve 166 has been disengaged, the method 196 may continue to block 210, where it is determined whether there has been any further pressure drop in the air reservoir 80. For instance, if there is no additional load for five minutes, the clutch 164 may also be disengaged (block 212), further decreasing the load on the service engine 32. This may allow for more power being available from the service engine 32 for other functions and, additionally, may decrease fuel usage. However, if there has been further pressure drop in the air reservoir 80, the method 196 may continue to block 202, where the controller may again determine whether the change in pressure is below the pre-determined value. Once the service engine 32 is at its lowest operating speed and the valve 166 and clutch 164 have been disengaged, the method 196 may continue to block 200, where the controller 124 may resume monitoring for further pressure drops in the air reservoir 80.

If, at block 202, the controller 124 determines that the pressure drop in the air reservoir 80 is above the pre-determined value, the method 196 may continue to blocks 214 and 216, where the valve 166 and/or clutch 164 may be engaged and the operating speed of the service engine 32 may gradually be increased. In certain embodiments, for changes in pressure within the air reservoir 80 greater than a certain amount (e.g., 1%, 2%, 3%, 4%, 5%, and so forth), a "high load flag" may be set, and the controller 124 may cause the speed of the service engine 32 to be increased. For a "high load flag," the operating speed of the service engine 32 may increase to 3200 rpm and even 3600 rpm, if necessary.

If the change in pressure does not cause a "high load flag," the controller 124 may compare the difference in pressure from the maximum pressure. If the pressure is below a first pressure level (e.g., 20-40% of the difference between the maximum and minimum pressure settings), the valve 166 may be opened and the air compressor 38 may begin pushing air into the air reservoir 80. If the load continues to cause the pressure to drop and the pressure falls below a second pressure level (e.g., 40-60% of the difference between the maximum and minimum pressure settings), the operating speed of the service engine 32 may be increased such that the pressure is prevented from dropping further. If the load is so high that the pressure drops below the minimum pressure setting, the controller 124 may increase the operating speed of the service engine 32 to a maximum operating speed (e.g., 3600 rpm). In other embodiments, the operating speed of the service engine 32 may be continuously variable proportional to the pressure drop, as opposed to be increased at incremental steps.

Therefore, the controller 124 may ensure that, under certain operating conditions, the pressure drop in the air reservoir 80 does not have to reach the minimum pressure setting before the air compressor 38 begins pushing air into the air reservoir 80. As such, the pressure in the air reservoir 80 may be maintained closer to the maximum pressure setting for greater periods of time while still ensuring that the service engine 32 runs at a relatively low operating speed. Under certain conditions, this may lead to a substantial increase (e.g., 20%, 25%, 30%, 35%, and so forth) in usable time for the air compressor 38. In other words, periods of time where an operator of the air compressor 38 will be kept waiting while the service engine 32 powers back up to fill the air reservoir 80 with air may be substantially reduced.

Other embodiments of the load control system 122 described above may be utilized. For instance, instead of detecting loads on the air compressor 38 by monitoring pressure changes in the air reservoir 80, in certain embodiments, a flow meter (e.g., a positive displacement flow meter) may be used to measure the flow rate of air from the air reservoir 80. By measuring the flow of air from the air reservoir 80, loads on the air compressor 38 may be estimated by the controller 124. In addition, instead of using a service engine 32 with discrete operating speeds, a variable speed service engine 32 may be used. In fact, the ability to vary the speed of the service engine 32 across a broader range of operating points may lead to more precise control of the pressure within the air reservoir 80. Also, in certain embodiments, the controller 124 may simply turn the air compressor 38 on when the pressure within the air reservoir 80 decreases to the minimum pressure setting and turn the air compressor 38 off when the pressure within the air reservoir 80 increases to the maximum pressure setting. In other embodiments, the operating speed of the service engine 32 may be adjusted based on other operating parameters indicative of the load on the air compressor 38. For instance, the operating speed of the service engine 32 may be adjusted based on temperature of the compressed air, stress/strain on the air reservoir 80, power and/or output of the equipment driven by the compressed air, an on/off state of the equipment driven by the compressed air, ratings/demand of the equipment driven by the compressed air, and so forth.

The disclosed embodiments provide several advantages. For example, the load control system 122 may reduce the overall noise generated by the service engine 32 and air compressor 38 by running the service engine 32 only as fast as needed to satisfy the load requirements on the air compressor 38. In addition, the load control system 122 may increase the fuel economy of the service engine 32 since the lower operating speeds may generally lead to lower fuel consumption by the service engine 32. Also, the load control system 122 may allow an operator to set the minimum and maximum pressure settings. This may help by increasing the output of the air compressor 38 before the tools used by the operator run out of air. For example, tools often have certain pressure ratings and, if the tool being used requires 130 pounds per square inch (psi) of pressure from the air reservoir 80 and the minimum pressure setting is 100 psi, the tool will operate at reduced efficiency when the pressure drops below 130 psi. The air compressor 38 will not turn back on until it reaches 100 psi, the minimum pressure setting. However, if the minimum pressure setting is changed to 130 psi, the next time the pressure drops from the maximum pressure to 130 psi, the air compressor 38 will turn on and keep the 130 psi of pressure supplied to the tool. This option allows the operator to set the air compressor 38 to whatever settings satisfy the operator's particular requirements. In other words, the air compressor 38 is user-adjustable to ratings of the equipment used and/or loads applied to the equipment, rather than just having a standard minimum pressure setting. In addition, another advantage is that the load control system 122 does not require an expensive flow meter, although one may be used. Rather, the load control system 122 utilizes pressure sensors and monitors changes in pressure over time.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A service pack, comprising:

an air compressor configured to output a compressed air to drive operation of at least one pneumatic tool;

an engine configured to drive the air compressor; and a controller configured to sense a load on the air compressor, wherein the controller is configured to:

selectively change an operating speed of the engine to a modified speed in response to a sensed feedback indicating a change in the load on the air compressor, the modified speed is proportional to the load, the modified speed is increased before the compressed air reaches a lower pressure threshold; and selectively change an operating state of the air compressor between engaged and disengaged states while the engine is operating at least partially based on the sensed feedback, wherein the controller is configured to progressively decrease the operating speed of the engine and subsequently change the operating state of the air compressor from the engaged state to the disengaged state in response to progressive decreases in the load, and the controller is configured to change the operating state of the air compressor from the disengaged state to the engaged state and subsequently progressively increase the operating speed of the engine in response to progressive increases in the load.

2. The service pack of claim 1, comprising an air reservoir configured to receive air from the air compressor, wherein the controller is configured to determine the load on the air compressor by determining at least two of a rate of pressure change associated with the air compressor, a percentage of pressure change associated with the air compressor, or an amount of pressure change at an intermediate pressure level between upper and lower pressure thresholds associated with the air compressor, or a combination thereof.

3. The service pack of claim 1, comprising a flow meter configured to measure a flow of air from the air compressor, wherein the controller is configured to determine the load on the air compressor by monitoring the flow of air measured by the flow meter.

4. The service pack of claim 1, comprising a clutch configured to control a transfer of power from the engine to the air compressor, wherein the controller is configured to selectively engage or disengage the clutch to selectively enable or disable the air compression by the air compressor based at least partially on the sensed load on the air compressor, wherein an adjustment of the clutch changes the air compressor between the disengaged states.

5. The service pack of claim 1, comprising a valve configured to control a flow of air associated with the air compressor, wherein the controller is configured to selectively open or close the valve to selectively enable or disable the air compression by the air compressor based at least partially on the sensed load on the air compressor, wherein an adjustment of the valve changes the air compressor between the engaged and disengaged states.

6. The service pack of claim 1, wherein the controller is configured to selectively change the operating speed of the engine to the modified speed at least partially based on a rating, a demand, a power, and/or an output of equipment driven by the compressed air from the air compressor.

7. The service pack of claim 1, wherein the controller is configured to determine the load on the air compressor by determining a percentage of pressure change associated with the air compressor.

8. The service pack of claim 1, wherein the controller is configured to selectively change the operating speed of the engine to the modified speed at least partially based on a rating of equipment driven by the compressed air from the air compressor.

9. The service pack of claim 1, wherein the engine comprises a continuously variable speed engine, and the modified speed is continuously proportional to the load.

10. The service pack of claim 1, wherein the engine is power matched to the load by changing the operating speed to the modified speed proportional to the load.

11. The service pack of claim 1, wherein the engine comprises discrete operating speeds, the modified speed is one of the discrete operating speeds proportional to the load, and the lower pressure threshold is user adjustable.

12. The service pack of claim 1, wherein the modified speed is variable to a plurality of different speeds as the load varies between an upper threshold and a lower threshold.

13. The service pack of claim 1, wherein the modified speed variably increases to a plurality of speeds between a lower speed and an upper speed proportional to the load increasing to a plurality of loads between a lower load and an upper load, wherein the modified speed is decreased before the compressed air reaches an upper pressure threshold.

14. The service pack of claim 1, wherein the controller is configured to selectively change the operating state of the air compressor from the engaged state to the disengaged state if the sensed feedback indicates that the load is below a lower load threshold for a duration of time, and the controller is configured to selectively change the operating state of the air compressor from the disengaged state to the engaged state if the sensed feedback indicates an increase in the load.

15. A system, comprising:

an engine speed controller configured to:

selectively change an operating speed of an engine to a modified speed in response to a sensed feedback indicating a change in a load on an air compressor driven by the engine, wherein the modified speed is proportional to the load, and the modified speed is increased before the compressed air reaches a lower threshold; and selectively change an operating state of the air compressor between engaged and disengaged states while the engine is operating at least partially based on the sensed feedback, wherein the engine speed controller is configured to progressively decrease the operating speed of the engine and subsequently change the operating state of the air compressor from the engaged state to the disengaged state in response to progressive decreases in the load, and the engine speed controller is configured to change the operating state of the air compressor from the disengaged state to the engaged state and subsequently progressively increase the operating speed of the engine in response to progressive increases in the load.

16. The system of claim 15, wherein the engine speed controller is configured to selectively increase or decrease an operating speed of the engine based at least partially on a first evaluation of a load on the air compressor, and the engine speed controller is configured to selectively enable or disable air compression by the air compressor based at least partially on a second evaluation of the load on the air compressor.

17. The system of claim 16, comprising a clutch configured to control a transfer of power from the engine to the air compressor and a valve configured to control a flow of air associated with the air compressor, wherein the engine speed controller is configured to selectively engage or disengage the clutch or selectively open or close the valve to selectively enable or disable the air compression by the air compressor based at least partially on the sensed feedback, wherein an adjustment of the clutch or the valve changes the air compressor between the engaged and disengaged states.

18. The system of claim 15 wherein the engine speed controller is configured to selectively decrease the operating speed of the engine from a first speed to a second speed if the change in pressure associated with the air compressor is less than a first threshold, and the engine speed controller is configured to selectively decrease the operating speed of the engine from the second speed to a third speed if the change in pressure associated with the air compressor is less than a second threshold.

19. The system of claim 15, wherein the engine speed controller is configured to selectively change the operating speed of the engine to the modified speed at least partially based on a rating, a demand, a power, and/or an output of equipment driven by a compressed air from the air compressor.

20. The system of claim 15, wherein the modified speed is variable to a plurality of different speeds as the load varies between an upper threshold and a lower threshold, the engine speed controller is configured to selectively change the operating speed of the engine to the modified speed at least partially based on a rating of equipment driven by a compressed air from the air compressor, and at least one of the upper or lower threshold is user adjustable.

21. The system of claim 15, wherein the modified speed variably increases to a plurality of speeds between a lower speed and an upper speed proportional to the load increasing to a plurality of loads between a lower load and an upper load, wherein the modified speed is decreased before the compressed air reaches an upper threshold.

22. The system of claim 15, wherein the engine speed controller is configured to selectively change the operating state of the air compressor from the engaged state to the disengaged state if the sensed feedback indicates that the load is below a lower load threshold for a duration of time, and the engine speed controller is configured to selectively change the operating state of the air compressor from the disengaged state to the engaged state if the sensed feedback indicates an increase in the load.

23. A method, comprising:

determining a load on an air compressor driven by an engine; and selectively changing an operating speed of the engine to a modified speed in response to a determined load indicating a change in the load on the air compressor, wherein the modified speed is proportional to the load, and the modified speed is increased before the compressed air reaches a lower threshold; and selectively changing an operating state of the air compressor between engaged and disengaged states while the engine is operating at least partially based on the determined load, wherein selectively changing comprises progressively decreasing the operating speed of the engine and subsequently changing the operating state of the air compressor from the engaged state to the disengaged state in response to progressive decreases in the load, and selectively changing comprises changing the operating state of the air compressor from the disengaged state to the engaged state and subsequently progressively increasing the operating speed of the engine in response to progressive increases in the load.

24. The method of claim 23, comprising determining the load on the air compressor by determining a rate of pressure change associated with the air compressor.

25. The method of claim 23, comprising determining the load of the at least one pneumatic tool on the air compressor by determining a percentage of pressure change associated with the air compressor.

26. The method of claim 23, comprising selectively engaging or disengaging a clutch or selectively opening or closing a valve to selectively enable or disable the air compression by the air compressor based at least partially on the determined load of the at least one pneumatic tool on the air compressor, wherein an adjustment of the valve or the clutch changes the air compressor between the engaged and disengaged states.

27. The method of claim 23, wherein selectively changing the operating speed of the engine to the modified speed is at least partially based on a rating, a demand, a power, and/or an output of equipment driven by a compressed air from the air compressor.

28. The method of claim 23, wherein selectively changing the operating speed of the engine to the modified speed is at least partially based on a rating of equipment driven by a compressed air from the air compressor.

29. The method of claim 23, wherein the modified speed is variable to a plurality of different speeds as the load varies between an upper threshold and a lower threshold.

30. The method of claim 23, wherein the modified speed variably increases to a plurality of speeds between a lower speed and an upper speed proportional to the load increasing to a plurality of loads between a lower load and an upper load, wherein the modified speed is decreased before the compressed air reaches an upper threshold.

31. The method of claim 23, the operating state of the air compressor is selectively changed from the state the disengaged state if the determined load is below a lower load threshold for a duration of time, and the operating state of the air compressor is selectively changed from the disengaged state to the engaged state in response to an increase in the determined load.

* * * * *